US006613244B2

(12) United States Patent
Fry

(10) Patent No.: US 6,613,244 B2
(45) Date of Patent: Sep. 2, 2003

(54) IRONING AID COMPOSITION

(75) Inventor: Alan John Fry, Port Sunlight (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/916,170

(22) Filed: Jul. 26, 2001

(65) Prior Publication Data

US 2003/0089878 A1 May 15, 2003

(30) Foreign Application Priority Data

Jul. 28, 2000 (EP) ..... 00306476

(51) Int. Cl.[7] ..... D06M 23/00
(52) U.S. Cl. ..... 252/8.91; 252/8.61; 38/144; 427/370
(58) Field of Search ..... 252/8.61, 8.91; 38/144; 427/370

(56) References Cited

U.S. PATENT DOCUMENTS 5,409,619 A 4/1995 DeRenzo ..... 252/8.6
5,695,677 A * 12/1997 Silvester et al. ..... 252/8.61
6,328,951 B1 * 12/2001 White et al. ..... 424/76.1

FOREIGN PATENT DOCUMENTS

| | | | |
|---|---|---|---|
| DE | 296 00 628 | | 5/1997 |
| DE | 298 19 061 | U1 | 6/1999 |
| DE | 299 18 926 | U1 | 3/2000 |
| DE | 199 31 349 | A1 | 4/2000 |
| EP | 0 089 256 | | 9/1983 |
| EP | 0 089 256 | A1 | 9/1983 |
| EP | 715662 | * | 3/1995 |
| GB | 2304740 | * | 3/1997 |
| GB | 2 304 740 | | 3/1997 |
| GB | 2 313 133 | | 11/1997 |
| GB | 2 333 302 | | 7/1999 |
| IT | 416 04A/86 | | 3/1989 |
| IT | 0125871 | | 6/1995 |

OTHER PUBLICATIONS

European Search Report dated Jan. 18, 2001.

* cited by examiner

*Primary Examiner*—Anthony J. Green
(74) *Attorney, Agent, or Firm*—Alan A. Bornstein

(57) ABSTRACT

This invention relates to an ironing aid composition which is suitable for pouring directly into the water reservoir chamber of a steam iron.

27 Claims, No Drawings

IRONING AID COMPOSITION

This invention relates to an ironing aid composition which is suitable for pouring directly into the water reservoir chamber of a steam iron wherein the composition is vaporised and released through the steam vents of the iron. The invention is also directed to a method for preparing an ironing aid composition and a concentrate ironing aid composition which after appropriate dilution provides the ironing aid composition ready for use.

A product which can be poured directly into the chamber of a steam iron and can effectively deliver a perfume to clothes being ironed has been desired by consumers for some time. These products are generally water based. However, the vast majority of perfume components is essentially insoluble in water and therefore requires an additional solubiliser to provide an isotropic solution (or microemulsion). For example DE 296 00 628 discloses a composition with oily fragrances which are hardly soluble or not soluble at all.

The usual route to solubilise a perfume in water is to include a surfactant/emulsifier typified by anionic, cationic, amphoteric, zwitterionic or particularly nonionic surfactants, most particularly alcohol ethoxylates. Many products currently on the market use this route to solubilise a perfume and achieve some level of perfuming. For example, GB 2 333 302 describes an ironing aid composition with a nonionic surfactant to disperse the hydrophobic fragrance.

However, tests carried out by the inventor have shown that known products to be dosed into the chambers of a steam iron can cause problems, due to the extreme temperatures experienced by the compositions. The temperature inside the steam chamber of a steam iron can normally vary between 150° C. and 270° C., and is usually around 200° C. for an iron set for ironing cotton fabrics.

Compositions consisting of demineralised water and 0.40 wt. % of the following common nonionic surfactants were made: Cremophor™ CO 40 (BASF—Hardened castor oil, ethoxylated to 40 EO), Softanol™ 90 (Ineos—$C_{12}$–$C_{14}$ mix of secondary alcohols, ethoxylated to 9 EO), Neodol™ 25-9 (Shell—$C_{12}$–$C_{15}$ mix of primary alcohols, ethoxylated to 9EO), Lial™ 111 10EO (Condea-$C_{11}$ alcohol, ethoxylated to 10 EO), Genapol™ 200 (Clariant-Coconut alcohol, ethoxylated to 20 EO). These compositions were dosed into steam irons which were then used to iron terry toweling hand towels. Burnt odours were given off during the use of the all of the compositions, which is not acceptable in a product intended to perfume laundry during ironing.

In a further test, the following compositions were tested in the steam chambers of Philips Mistral H1 312 irons:

(i) Demineralised water only;

(ii) 0.016 wt. % Nipacide™ (TM) BT LC (from Nipa Laboratories) & balance demineralised water;

(iii) 0.2 wt. % Cremophor™ C040 & balance demineralised water.

The irons were filled with the appropriate composition every day for 10 days and a 100% cotton pillowcase ironed on one side only until all the dosed product had been emitted as steam. The same pillowcases were ironed from use 1 to 5 per composition, then another pillowcase was used for uses 6 to 10. When the test was finished, the insides of the irons were examined for residue.

Compared to the demineralised water alone, the composition containing Nipacide™ or Cremophor™ resulted in brown marks on the pillowcases and particles being emitted from the irons. These were more noticeable after 6 or so uses. The composition containing Cremophor™ resulted in foam in the steam compartment and crackling of the iron throughout the tests.

On disassembly of the irons, it was observed that those irons which had contained the compositions containing either Nipacide™ or Cremophor™ contained unacceptable residues, which were more than those in the iron filled only with demineralised water.

An alternative method of solubilising perfumes is to use semi polar solvents such as ethanol, isopropyl alcohol, ipropylene glycol, diethylene glycol monobutyl ether or dipropylene glycol monobutyl ether. However, to satisfactorily solubilise sufficient amounts of conventional perfumes, high quantities of these solvents are required. This may result in some risk to the ironer's health due to Occupational Exposure Limits (OELs) being exceeded, significant risk of ignition of the solvent causing a fire, or the occurrence of an adverse reaction between the solvents and the iron. Furthermore, the odour of a composition including such a large amount of solvent can overpower that of the perfume, negating the purpose of the product.

The present invention seeks to provide an improved ironing aid composition. The inventors have now found that one or more of the problems associated with the prior art can be ameliorated e.g. by the use of a water-soluble perfume which may reduce the need for an additional solubiliser such as the surfactants described above.

Therefore, according to one aspect of the present invention, there is provided an ironing aid composition for use in a steam chamber of a steam iron comprising:

(a) 0.001 to 5 wt. % of a water-soluble perfume; and (b) water having a French Hardness of 20 or below.

In most cases it will be preferable to have at most 2, 1, 0.5 or most preferable 0.25 wt. % of water-soluble perfume. The composition may comprise any optional ingredients, the balance being water as described below.

Water solubility is determined by mixing the water-soluble perfume in 1 liter of demineralised water at 20° C., and stirring together for 60 minutes at 300 rpm using a standard mixing blade. The resulting mixture is stored for 7 days at 20° C., and after that period if the resulting mixture is in two phases, then-the perfume is not water-soluble. At least 0.01 wt. % of perfume should be able to dissolve according to this test. It is preferred that at least 0.05, 0.1, 0.2, 0.25, 0.5, 1, 3 or even 5 wt. % of the perfume is able to dissolve under these conditions.

Water-soluble Perfume

In one preferred embodiment the water-soluble perfumes according to the invention will comprise water-soluble solvent and perfume ingredients, and these may be the sole components of such a perfume. It is preferred that the water-soluble perfume is soluble according to the above test at least at the amount it is included in the composition, if not at a higher concentration.

With regard to the solvent in the perfume, the advantage of the presence of solvent is that it may increase the formulation space by enabling the use of more different compounds to create improved ironing aid compositions with more complex fragrances which are more consumer preferred. By using the water-soluble perfume according to the invention, less solvent may be used to stabilise the perfume ingredients in the ironing aid composition.

Therefore, according to one aspect of the invention the weight ratio of solvent to perfume ingredients in the water-soluble perfume is preferably no more than 20:1, more preferably 10:1, 6:1, 3:1 or 1:1. In some water-soluble perfumes the ratio may be as low as 1:2 or even 1:3 or 1:4.

Suitable water-soluble solvents include dipropylene glycol, propylene glycol, isopropyl alcohol(IPA), ethanol and mixtures thereof. The most preferred of these is dipropylene glycol.

Perfume ingredients (or fragrance ingredients) are well known to those skilled in the art, and are described in Perfume and Flavor Chemicals, Steffan Arctander (ISDN 75-91398). The solubility of individual perfume ingredients in water can be represented by the calculated partition coefficient (ClogP) of the ingredient between distilled water and octanol at 20° C. The lower the value of ClogP, the more water soluble the ingredient. For example, raspberry ketone has a ClogP of 1.072 and is very soluble in water, whereas rose acetate has a ClogP of 4.048 and is not easily soluble in water. The ClogP values are most conveniently calculated by the "CLOGP" program, available from Daylight CIS.

The water-soluble perfumes of the present invention preferably comprise at least 5 different perfume ingredients, more preferably at least 7, 10, 12 and most preferably 15 different perfume ingredients. This number of different fragrance components is usually required to provide a 'complex' fragrance suitable for use in modern laundry products.

It is therefore likely that the perfume ingredients of the water-soluble perfume used will have a range of ClogP values. A perfume with a higher proportion of components with a high ClogP value will require a higher ratio of solvent to perfume ingredients than a perfume with a lower level of ingredients with a high ClogP value. Thus, a perfume with less than 5 wt. % of perfume ingredients with a ClogP value of greater than 3 may have a ratio of solvent to perfume ingredients of 1:1 or 1:2. In contrast, a perfume where at least 20 wt. % of the perfume ingredients have ClogP values of greater than 3 may have a solvent to perfume ingredients ratio of 5:1 or 7:1.

Water

The water of the composition according to the invention should have a French Hardness of 20 or below, preferably 12 or below. Water with a French Hardness of 12 to 20 is usually termed Medium water, whilst that with a French Hardness of 5 to 12, soft water.

It is further preferred that the water of the composition has a French Hardness of less than 5 (sometimes called very soft water), and demineralised water is most preferred.

'Demineralised water' means water where a large proportion, if not substantially all, of the dissolved salts have been removed. Water where the hardness ions ($Ca^{2+}$ and $Mg^{2+}$) have simply been replaced by other ions (such as $Na^{+}$) is not as preferred. The term 'Demineralised water' also includes distilled water.

It is preferred that the composition comprises at least 70 wt. %, more preferably 80, 90 , 95 or 99 wt. % of water.

Preservative

The ironing aid composition of the present invention may further comprise between 0.1 ppm and 3 wt. % of a preferably water-soluble preservative.

The preservative preferably should not release or decompose to chemicals which are potentially harmful to the ironer at the temperatures encountered in a steam iron, i.e. preferably at 150, 200 or even 250° C. A guide to safe limits of numerous chemicals is provided by Occupational Exposure Limits which are available from OHSE and are listed in EH40, available from HMSO.

Many known preservatives, e.g. Bronopol™ (Myacide), Dowicil™ 75 or 200, Germaben™ II, Germall™ I 15, Germall™ II, Glycacil™, Glydant™, Glydant™ plus, Oxaban™ A and Suttocide™ can release or breakdown to harmful or irritating chemicals (e.g. formaldehyde) at the temperatures encountered in steam irons or leave unacceptable residues in the steam irons, or have odours that mask that of the water-soluble perfumes at concentrations required to provide effective preservation against bacterial and mould growth.

If a preservative, other than those defined as preferable, is to be included in the composition, then it should not be present at an amount of greater than 0.5 wt. %, more preferably 0.1, 0.001, 0.0001 wt. %, most preferably 1 ppm.

In one embodiment of the invention, the ironing aid composition comprises at least one preservative selected from aromatic, linear or branched C1–C20 alcohols and mixtures thereof, and may be present in an amount of between 0.1 ppm and 3 wt. % or preferably 0.5 and 1 wt. %. Preferably, at least one preservative is selected from benzyl alcohol (phenoxy methanol) and phenoxy ethanol and mixtures thereof. Of these preservatives, benzyl alcohol is more preferred. If benzyl alcohol is used, preferably a high purity grade is employed, to minimise the presence of the known impurity, benzaldehyde, which is preferably essentially absent from the composition according to the invention, i.e., so low that ironing aid composition can still be safely used.

In a furtherembodiment of the invention, one preferred preservative comprises at least one isothiazolone-based compound, e.g., Kathon™ CG ICP II (available from Rohm and Haas), a 3:1 mixture of 5-chloro-2-methyl-3(2H)-isothiazolone and 2-methyl-3(2H)-isothiazolone with a low salt content, which may be present at an amount of between 1 and 15 ppm, more preferably 4 to 7.5 ppm.

The water solubility of the preservative can be measured as for the water soluble perfume, and according to the test defined above, at least 0.01 wt. %, more preferably 0.05, 0.1, 0.2, 0.25, 0.5, 1 or 3 wt. % of the water-soluble preservative should dissolve. In the alternative, it is preferred that the water-soluble preservative is soluble according to this test at least at the amount it is included in the composition, if not at a higher concentration.

It may not be necessary toinclude a preservative in the composition according to the invention, if the composition can be manufactured using good manufacturing practices and contamination of the product by bacteria and fungi is thus avoided.

Buffers

It is preferred that compositions for dosing in the water reservoir chamber of steam irons are neutral or slightly alkaline, as is most tap water. Therefore buffers may be included in the composition of the present invention in order to adjust the pH of the solution such that it is greater than or equal to 6, preferably 7 to 9 more preferably 7 to 8. Such buffers may be included in amounts of between 0.0001, preferably 0.001 to 0.1 or 1 wt. %.

Buffers which are suitable for use in the present invention should preferably be non-corrosive, low in odour and leave little deposits in the steam chamber.

Suitable buffers may include carbonate/bicarbonate, borate and phosphate salts.

Sequestrants

Compositions of the present invention may also include sequestrants and scale poisoning agents in an amount of between 0.0001, preferably 0.001 to 0.1 or 1, or even 3 wt. %, in order to prevent the deposition of limescale and other unwanted salts in the steam chamber of the iron.

Sequestrants are compounds that act to sequester (chelate) metal ions, and, for example, include phosphonic or carboxylic acid functionalities, whereas scale-poisoning agents interfere with the scale formation process. Sequestrants and scale poisoning agents which are suitable for use in the present invention should preferably be non-corrosive, low in odour and leave little deposits in the steam chamber.

Suitable sequestrants include organo diphosphonic acids, such as Dequest™ 2016 (HEDP; 1-hydroxyethylene-1,1-diphosphonic acid), organo aminophosphonates, such as Dequest™ 2047 (EDTMP), and polyaminocarboxylic acids, such as EDTA.

Scale poisoning agents include acrylic acid containing organic polymers, such as polyacrylic acid maleic anhydride copolymers (e.g. Sokolan™ CP5 from BASF and Narlex™ LD20 from National Starch), salts of polyacrylic acids, and polyacrylic acid homopolymers.

Auxiliary Solvent

Usually the ironing aid composition according to one aspect of the invention will be prepared by mixing a water-soluble perfume with water having a French hardness of 20 or below. In most cases the water-soluble perfume will comprise water-soluble perfume ingredients and a solvent. In addition, an auxiliary solvent may be included in the invention in an amount of 0.01 to 5 or possibly 20 wt. %, more preferably 0.1 to 5 or 10 wt. %, most preferably 0.2 to 1 or 2 wt. %.

Suitable auxiliary solvents include dipropylene glycol, glycerine, propylene glycol, ethanol and isopropyl alcohol (IPA) and mixtures thereof. The most preferred of these is dipropylene glycol. We have found that dipropylene glycol may be especially useful in ironing applications as a humidifier to facilitate ironing. Therefore, another aspect of the invention provides the use of an effective amount of dipropylene glycol for an ironing aid application. The ironing aid composition comprising the effective amount of dipropylene glycol can be used either directly on laundry items before ironing or can be used via the steam chamber of a steam iron. According this aspect of the invention, the ironing aid composition comprises (a) an effective amount of dipropylene glycol, preferably up to and including about 25 wt. %, more preferably 15, 10, 5, or even 2 or 3 wt. %. The lower limit on the total dipropylene content may be as low as 0.001 wt. %, or may be 0.01, 0.1 or 1 wt. %;

(b) 0.001 to 5 wt. % of preferably water-soluble perfume ingredients; and (c) water with a French Hardness of 20 or below.

The amount of ethanol and/or isopropyl alcohol (IPA) in the composition preferably does not exceed 5% by weight.

The total level of solvent in the composition, including the solvent that can be present in the water-soluble perfume, can therefore be up to and including about 25 wt. %, more preferably 15, 10, 5, or even 2 or 3 wt. %. The lower limit on the total solvent content may be as low as 0.001 wt. %, or may be 0.01, 0.1 or 1 wt. %. Since it will be obvious to the skilled person in the art that it does not matter whether the solvent is added as part of the perfume or separate from the perfume, the term water-soluble perfume is preferably to be interpreted as water-soluble perfume ingredients. Thus, preferably the ironing aid composition comprises 0.001 to 5 wt. % of water-soluble perfume ingredients and water having a French Hardness of 20 or below and a total amount of solvent of from 0.001 to 25 wt. % of the total composition. For example, for the solubility test the term water-soluble perfume preferably refers to the mixture of perfume ingredients and the total amount of solvent present in the perfume and any additional solvent.

Surfactants

Surfactants are compounds having a hydrophilic head and a hydrophobic tail which contains at least 8 carbon atoms, and can be anionic, cationic, nonionic, or amphoteric (which includes zwitterionic).

Anionic surfactants contain as their hydrophilic head a carboxylate, sulphate, sulphonate or phosphate group, whilst their hydrophobic chain contains an alkyl group of at least 8 carbon atoms, possibly in combination with an aryl group.

Cationic surfactants contain as their hydrophilic head quaternary nitrogen group, whilst their hydrophobic chain contains one or more alkyl groups of at least 8 carbon atoms.

Nonionic surfactants are the reaction product of a hydrophobic group with a reactive hydrogen and an alkylene oxide, usually ethylene oxide. The hydrophobic group will contain at least 8 carbon atoms, and is usually a primary or secondary alcohol.

Amphoteric surfactants will either have a carboxylate, or sulphate head group, or will be an amine oxide; and will contain alkyl chains having at least 8 carbon atoms.

It is preferred that compositions of the present invention comprise less than 0.2 wt. % of these surfactants, more preferably less than 0.1, 0.05, 0.01, 0.001 wt. % and most preferably less than 1 ppm of these surfactant. It should be understood that the phrase "less than" in this case also encompasses 0 wt. % surfactant. In fact in some cases it may be preferred to have no surfactant present.

Overall Composition

Compositions according to the invention may consist of a water-soluble perfume and water with a French Hardness of 20 or below, and also of any of the optional components described above.

Preferably the overall composition is storage stable at 20° C., i.e. it does not separate into two phases on extended storage (preferably at least 1 month). It is further preferred that the overall composition is storage stable at between 5° C. and 37° C.

Preparation

An ironing aid composition comprising perfume can be prepared in many ways known to the person skilled in the art. However, we have now found an improved process for preparing an ironing aid composition. One advantage is that relatively high concentrations of perfume can be incorporated in the aqueous carrier with minimal bacterial contamination. Therefore, one further aspect of the present invention provides a improved process for preparing an ironing aid composition comprising the step of mixing perfume with water having a French hardness of 20 or less at a temperature between 10 and 95° C., preferably 60 and 90° C., most preferably between 70 and 85° C. Preferably, the perfume is water-soluble as described above. In one preferred process the water-soluble perfume comprises water-soluble solvent and perfume ingredients, the weight ratio of water-soluble solvent to perfume ingredients being no more than 20:1.

The mixing may-be performed under low shear for relatively long periods e.g. 30 minutes at about 100 to 4000s-1 with for example a Sulzer static mixer (SMV type). However, it may be preferred-to use higher shear rates e.g. with a Silverson dynamic mill (45/600ULS) at shear rates of 180000s-1 to minimise the time needed for mixing. Most preferably is a process that combines a first step at a low shear rate of 100 to 4000s-1 and a second step at a high shear rate of 50000 to 300000s-1, especially in a continuous process of preparing the ironing aid composition.

Packaging

The ironing aid composition of the present invention can be packaged by any conventional means, for instance in bottles or pouches, these being made from conventional materials. It is however preferred that if the composition is packaged in a bottle, the material from which the bottle is made comprises PET (polyethylene tetraphalate). This is preferred as it prevents perfume loss from the product on storage, and is transparent. Glass is also a preferred packaging material.

It is also preferred that the bottle comprises a pour spout to aid pouring of the product from the bottle into a domestic steam iron. Preferably, the pour spout comprises a through spout for the liquid composition to pass through from the bottle, an annular drip tray which surround the through spout, and a drain hole in said drip tray to allow fluid to pass into the bottle.

Concentrate

A further aspect of the present invention relates to a concentrate that when diluted with water, preferably having a French hardness of 20 or below, results in an ironing composition according to the present invention. Preferably, the dilution is such that one part of concentrate is diluted with between 0.5 to 100, more preferably, between 1 and 10, most preferably between 2 and 5 parts of water (w/w). The exact composition of the concentrate can be easily calculated given the desired end concentration in the ironing aid composition and the dilution factor. For example when the end concentration of perfume in the ironing aid composition has to be between 3.0 and 5.0 wt % than the dilution factor will be limited to at most 20. It will be obvious to the skilled person that when higher dilution factors are used e.g. 100, the diluted ironing aid composition will necessarily comprise lower maximal perfume levels i.e., theoretically at most 1 wt. % of perfume. In most cases in will be preferred to have perfume levels in the ironing aid composition of at most 0.5 wt. %

The concentrate could also be diluted by water having a French hardness of greater than 20 to result in a composition according to the first aspect of the invention, except containing hard water. In this aspect, the concentrate preferably contains sequestrants and/or scale-poisoning agents.

Thus, the present invention provides a concentrate ironing aid composition for use in a steam chamber of a steam iron when diluted by water comprising a water-soluble perfume, as defined above.

If water is absent from this concentrate, then the need for a preservative is reduced, or even eliminated. Therefore in one preferred embodiment of this aspect of the present invention, the concentrate contains no water or preservative.

If a weaker concentrate is required, then auxiliary solvent may be required to ensure the water-soluble perfume remains solubilised in the concentrate. Auxiliary solvent may also be required if any of the additional components defined above are to be included in the concentrate.

Thus, if the amount of water in the concentrate is half that of the final product then additional solvent may be required at a level of 20 to 30 wt. %.

According to one aspect of the invention a method is provided for using a concentrate ironing aid composition comprising the step of diluting the concentrate to form an ironing aid composition comprising 0.001 to 5 wt. % water-soluble perfume and water having a French Hardness of 20 or below.

Other than in the examples, or where otherwise indicated, all numbers expressing quantities of ingredients or reaction conditions used herein are to be understood as modified in all instances by the term "about". Similarly, all percentages are weight/weight percentages of the total composition unless otherwise indicated. Where the term "comprising" is used in the specification or claims, it is not intended to exclude any terms, steps or features not specifically recited.

The invention is more fully illustrated by the following non-limiting examples showing some preferred embodiments of the invention.

EXAMPLE 1

The following two compositions were made by adding the perfume in the required amount to the demineralised water and stirring at room temperature (20° C.) at 500 rpm for 15 minutes:

| Component | A | B |
|---|---|---|
| Sol & Fresh 2 | 0.1 wt. % | — |
| LF1806 | — | 0.05 wt. % |
| Demineralised Water | 99.9 wt. % | 99.95 wt. % |

Sol & Fresh 2 is a water-soluble perfume from Givaudan-Roure (Geneva, Switzerland). It consists of about 51 wt. % solvent (dipropylene glycol). 96.6 wt. % of the fragrance components have a ClogP value of less than 2, and 3.4 wt. % of the fragrance components have a ClogP value of greater than 3.

LF 1806 is a water-soluble perfume from Quest (Ashford, UK). It consists of about 87 wt. % solvent (dipropylene glycol). 54.8 wt. % of the fragrance components have a ClogP value of less than 2, 24.7 wt. % a ClogP value of between 2 and 3, and 20.5 wt. % of the fragrance components have a ClogP value of greater than 3.

Compositions A and B were tested in a variety of steam irons under normal use conditions in around a total of 550 ironing sessions, which generally lasted between 15 and 45 minutes. In over 80% of sessions no deposits were observed from the iron, and in most of the remainder of sessions only a small amount were observed, and these deposits did not tend to stain the fabric. It is likely that the deposits observed were associated with the compositions cleaning the iron to some extent.

Overall, the users reported that the compositions had a smell which they liked, and that the compositions gave a pleasant smell when ironing and made the clothes ironed smell fresh and clean.

EXAMPLE 2

The following compositions were made as in example 1, with addition of the benzyl alcohol along with the perfume, and tested in the steam chambers of various irons.

| | wt. % | |
|---|---|---|
| Components | A | B |
| Perfume (LF1806A) | 0.12 | — |
| Perfume (Sol & Fresh 4) | — | 0.15 |
| Benzyl Alcohol | 0.5 | 0.5 |
| Demineralised Water | to 100 | to 100 |

Sol & Fresh 4 is a water-soluble perfume from Givaudan-Roure. It consists of about 30 wt. % solvent (dipropylene glycol). 56 wt. % of the fragrance components have a ClogP value of less than 2, 36 wt. % a ClogP value of between 2 and 3 and 8 wt. % of the fragrance components have a ClogP value of greater than 3.

LF 1806A is a water-soluble perfume from Quest (Ashford, UK). It consists of about 85 wt. % solvent (dipropylene glycol). 56.9 wt. % of the fragrance components have a ClogP value of less than 2, 24.6 wt. % a ClogP value of between 2 and 3, and 18.5 wt. % of the fragrance components have a ClogP value of greater than 3.

EXAMPLE 3

The following compositions were made for using the steam chambers of steam irons by mixing the components with demineralised water for 30 minutes at 400 rpm at 20° C.:

| | A | B | C wt. % | D | E |
|---|---|---|---|---|---|
| LF1806A | 0.10 | — | 0.05 | 0.05 | 0.05 |
| Sol & Fresh 4 | — | 0.15 | — | — | — |
| Kathon ™ CG ICP II | 0.00075 | — | — | — | — |
| Benzyl Alcohol | — | 0.50 | — | — | — |
| Ethanol | 1.0 | 3.0 | — | — | — |
| Sokolan CP 5 | — | — | 0.10 | — | — |
| $Na_4EHDP$ | — | — | — | 0.01 | — |
| Na Bicarbonate | — | — | — | — | 0.05 |
| Demin. Water | to 100 | To 100 | to 100 | to 100 | to 100 |

EXAMPLE 4

The compositions as listed in Example 2 were prepared with the exception that the perfume was mixed with demineralised water at 80° C. using a Silverson dynamic mill (45/600ULS) at shear rates of 180000s-1 for 1 min.

What is claimed is:

1. An ironing aid composition for use in a steam chamber of a steam iron comprising:

(a) 0.001 to 5 wt. % of a water-soluble perfume;

(b) water with a French Hardness of 20 or below; and (c) less than 0.1% wt. % of any one of a component selected from an anionic, cationic, nonionic or an amphoteric surfactant, wherein the water-soluble perfume comprises water-soluble solvent and perfume ingredients, the weight ratio of water-soluble solvent to perfume ingredients being no more than 20:1.

2. An ironing aid composition according to claim 1, comprising 0.1 ppm to 3 wt. % of at least one preservative selected from aromatic, linear or branched C1–C20 alcohols or mixtures thereof.

3. An ironing aid composition according to claim 2, wherein the preservative is present in an amount of between 0.5 and 1 wt. %.

4. An ironing aid composition according to claim 1, wherein a preservative is present and comprises 0.1 ppm to 3 wt. % of at least one isothiazolone-based compound.

5. An ironing aid composition according to claim 4, wherein the preservative is present in an amount of between 1 and 15 ppm.

6. An ironing aid composition according to claim 1, which further comprises a 0.0001 to 1 wt. % of a buffer, such that the pH of the composition is greater than or equal to 6.

7. An ironing aid composition according to claim 1, which further comprises 0.0001 to 3 wt. % of sequestrants and/or scale-poisoning agents.

8. An ironing aid composition according to claim 1, wherein a solvent is present from 0.001 to 25 wt. %.

9. An ironing aid composition according to claim 8, wherein the solvent is selected from dipropylene glycol, propylene glycol, isopropyl alcohol, ethanol or mixtures thereof.

10. A process for preparing an ironing aid composition according to claim 1 comprising the step of mixing perfume with water having a French hardness of 20 or less at a temperature between 10 and 95° C. wherein the perfume is a water-soluble perfume.

11. A concentrate ironing aid composition, which when diluted with water having a French hardness of 20 or below provides an ironing aid composition according to claim 1.

12. A method of using an ironing aid composition according to claim 1 comprising delivering the water-soluble perfume to clothes being ironed with a steam iron.

13. An ironing aid composition for use in a steam chamber of a steam iron comprising:

(a) 0.001 to 5 wt % of a water-soluble perfume;(b) water with a French Hardness of 20 or below;

(c) between 0.1 ppm and 3 wt % of a water-soluble preservative; and (d) less than 0.2 wt. % of any one of a component selected from an anionic, cationic, nonionic, or an amphoteric surfactant.

14. An ironing aid composition according to claim 13, wherein the water-soluble perfume comprises water-soluble solvent and perfume ingredients, the weight ratio of water-soluble solvent to perfume ingredients being no more than 20:1.

15. An ironing aid composition according to claim 13, further comprising at least one preservative selected from aromatic, linear or branched C1–C20 alcohols or mixtures thereof.

16. An ironing aid composition according to claim 15, wherein the preservative is present in an amount of between 0.5 and 1 wt. %.

17. An ironing aid composition according to claim 13 comprising 0.1 ppm to 3 wt. % of at least one isothiazolone-based compound.

18. An ironing aid composition according to claim 17, wherein the preservative is present in an amount of between 1 and 15 ppm.

19. An ironing aid composition according to claim 15 wherein the preservative is selected from benzyl alcohol, phenoxy ethanol or mixtures thereof.

20. An ironing aid composition according to claim 13, which further comprises 0.0001 to 3 wt. % of sequestrants and/or scale-poisoning agents.

21. An ironing aid composition according to claim 13, wherein a total amount of solvent is from 0.001 to 25 wt. %.

22. An ironing aid composition according to claim 21, wherein the solvent is selected from the group of dipropylene glycol, propylene glycol, isopropyl alcohol, ethanol or mixtures thereof.

23. An ironing aid composition according to claim 15 wherein the preservative is selected from benzyl alcohol, phenoxy ethanol or mixtures thereof.

24. A process for preparing the ironing aid composition of claim 13 comprising the step of mixing perfume with water having a French hardness of 20 or less at a temperature between 10 and 95° C.; wherein the final composition contains between 0.1 and 3 wt. % of a water-soluble preservative.

25. A process according to claim 24 wherein the perfume is a water-soluble perfume.

26. A process according to claim 25 wherein the water-soluble perfume comprises water-soluble solvent and perfume ingredients, the weight ratio of water-soluble solvent to perfume ingredients being no more than 20:1.

27. A method of using an ironing aid composition according to claim 13 comprising the steps of adding said composition to a steam iron and delivering said composition to clothes with the iron during an ironing process.

* * * * *